US006456232B1

(12) United States Patent
Milnes et al.

(10) Patent No.: US 6,456,232 B1
(45) Date of Patent: Sep. 24, 2002

(54) SYSTEM FOR DETERMINING INFORMATION ABOUT A GOLF CLUB AND/OR A GOLF BALL

(75) Inventors: Kenneth A. Milnes, Fremont; Marvin S. White, San Carlos; Richard H. Cavallaro, Mountain View; Stanley K. Honey, Palo Alto; Fred Judson Heinzmann, Los Altos, all of CA (US)

(73) Assignee: Sportvision, Inc., New York, NY (US)

( * ) Notice: Subject to any disclaimer, the term of this patent is extended or adjusted under 35 U.S.C. 154(b) by 0 days.

(21) Appl. No.: 09/444,790

(22) Filed: Nov. 22, 1999

(51) Int. Cl.[7] ..... G01S 13/58; A63B 69/36

(52) U.S. Cl. ..... 342/107; 342/104; 473/199; 473/151

(58) Field of Search ..... 342/55, 104, 107, 342/109; 473/199, 101, 152, 219, 221, 222, 233, 257

(56) References Cited

U.S. PATENT DOCUMENTS

| | | | | |
|---|---|---|---|---|
| 4,146,230 A | | 3/1979 | Foster | 273/186 R |
| 4,163,941 A | | 8/1979 | Linn, Jr. | 324/178 |
| 4,254,956 A | | 3/1981 | Rusnak | 273/186 R |
| 4,451,043 A | | 5/1984 | Ogawa et al. | 273/186 R |
| 4,542,906 A | | 9/1985 | Takase et al. | 273/185 R |
| 4,545,576 A | * | 10/1985 | Harris | 473/468 |
| 4,577,863 A | | 3/1986 | Ito et al. | 273/26 R |
| 5,082,263 A | | 1/1992 | Berger | 273/29 R |
| 5,092,602 A | * | 3/1992 | Witler et al. | 473/199 |
| 5,138,322 A | | 8/1992 | Nuttall | 342/126 |
| 5,401,026 A | | 3/1995 | Eccher et al. | 273/184 R |
| 5,609,534 A | * | 3/1997 | Gebhardt et al. | 473/409 |
| 5,868,578 A | * | 2/1999 | Baum | 473/453 |
| 5,912,700 A | | 6/1999 | Honey et al. | 348/157 |
| 5,917,553 A | | 6/1999 | Honey et al. | 348/578 |
| 5,926,780 A | * | 7/1999 | Fox et al. | 473/152 |
| 6,042,492 A | * | 3/2000 | Baum | 473/453 |

FOREIGN PATENT DOCUMENTS

| | | | |
|---|---|---|---|
| CA | 2104761 | * 3/1994 | |
| GB | 2 110545 A | 6/1983 | A63B/69/36 |

OTHER PUBLICATIONS

*ESPN checks swings with Bat Track*, by Glen Dickson, Broadcasting & Cable, Jun. 22, 1998.

* cited by examiner

*Primary Examiner*—Ian J. Lobo
(74) *Attorney, Agent, or Firm*—Vierra Magen Marcus; Harmon & DeNiro LLP

(57) ABSTRACT

A system is disclosed that can determine the speed of a golf club or golf ball, and report that speed in a format suitable for use on a television broadcast, a radio broadcast, the Internet or another medium. In one embodiment, the system includes a set of radars pointed toward the golf ball. Data from the radars is collected and sent to a computer which can determine the speed of the club during a swing, the speed of the ball after being hit, the angle of the path of the ball and/or other related statistics.

63 Claims, 5 Drawing Sheets

SYSTEM FOR DETERMINING INFORMATION ABOUT A GOLF CLUB AND/OR A GOLF BALL

CROSS-REFERENCE TO RELATED APPLICATIONS

This Application is related to the following Application:

SYSTEM FOR DETERMINING THE SPEED AND/OR TIMING OF AN OBJECT, by Cavallaro, et al., Ser. No. 09/289,166, filed Apr. 9, 1999.

This related Application is incorporated herein by reference.

BACKGROUND OF THE INVENTION

1. Field of the Invention

The present invention is directed to a system for determining information about the movement of a golf club and/or a golf ball, and other similar objects.

2. Description of the Related Art

The remarkable, often astonishing, physical skills and feats of great athletes draw millions of people every day to follow sports that range from the power of football to the grace of figure skating, from the speed of ice hockey to the precision of golf. Sports fans are captivated by the abilities of a basketball player to soar to the rafters, of a baseball pitcher to overwhelm the best hitters in the world, a golfer to reach the green with a long and accurate drive, of a runner to explode down the track, etc. In televising these events, broadcasters have deployed a varied repertoire of technologies—ranging from slow-motion replay to lipstick-sized cameras mounted on helmets—to highlight for viewers these extraordinary talents. Not only are fans intrigued and excited by the efforts of athletes, their comparative abilities become topics of endless debate at water coolers, in sports bars, on the Internet, etc.

One piece of information that has never been readily and reliably available to fans of sports like golf is the speed that a golfer swings a club and the speed of the ball after being hit. Such information will not only create a statistic that reflects a critical athletic skill, but will also provide announcers with information that will enhance their analysis of the game. Subtle variations in different players' swings, now verifiable, may explain driving success. This information will be of tremendous interest to golf fans, and to date there have been no successful attempts to provide such information during the telecast of a game. Club speed and ball speed will quickly join other popular statistics like running speed and throwing distance in adding to viewers' appreciation of an athletic event.

There has been an attempt to measure and report golf club speed in the past. However, the prior art system was not accurate or reliable. This prior art system measured speed using a single radar that is positioned by the golfer.

Therefore, a system is needed that can determine the speed of a golf club and/or golf ball at desired times with sufficient accuracy to be of interest to a viewer of an event.

SUMMARY OF THE INVENTION

The present invention, roughly described, provides for a system for determining the speed of a golf club and/or golf ball. The determined speed can be reported in a format suitable for use on a television broadcast, radio broadcast, the Internet or another medium, etc. Additionally, the information can be made available to another software process or function, or another computer. Various embodiments of the present invention can also be used to measure information regarding the movement of other moving objects.

One method for practicing the invention includes automatically detecting the occurrence of a first event and determining the speed of an object during the first event. By automatically, it is meant that a human is not needed to detect the occurrence of the first event. The event detected could be the swinging of a golf club, a club hitting a ball, the movement of the ball, etc. The system can determine the speed of a ball after being hit, or at another time. The system can also determine the speed of a club during a swing, at the moment it hit a ball, or at various instants during a swing.

In one embodiment, the system includes sensing radar data using two or more radar units and storing that radar data. The radar units may provide data for multiple objects in motion. In one example, the present invention determines which data represents the swing of a club or the movement of the ball. Once the proper data is identified, the identified data is used to determine the speed of the club or ball. The present invention can also be used to determine when a club hit a ball and the speed of the club at that moment and/or other moments. In one embodiment, the system includes a set of two or more radars positioned behind the ball and pointing toward the ball along the intended path of the ball. Data from the radars is collected and sent to a computer which can determine the speeds and other information.

These and other objects and advantages of the invention will appear more clearly from the following detailed description in which the preferred embodiment of the invention has been set forth in conjunction with the drawings.

DETAILED DESCRIPTION

For illustrative purposes, the embodiments described below are used to measure the speed of a golfball and/or a golf club. However, the present invention can be used in conjunction with many different moving objects associated with many events and situations, including sporting events and events other than sporting events. For example, the present invention can be used to measure speed and other information for other balls or objects at other events.

Figure 1:
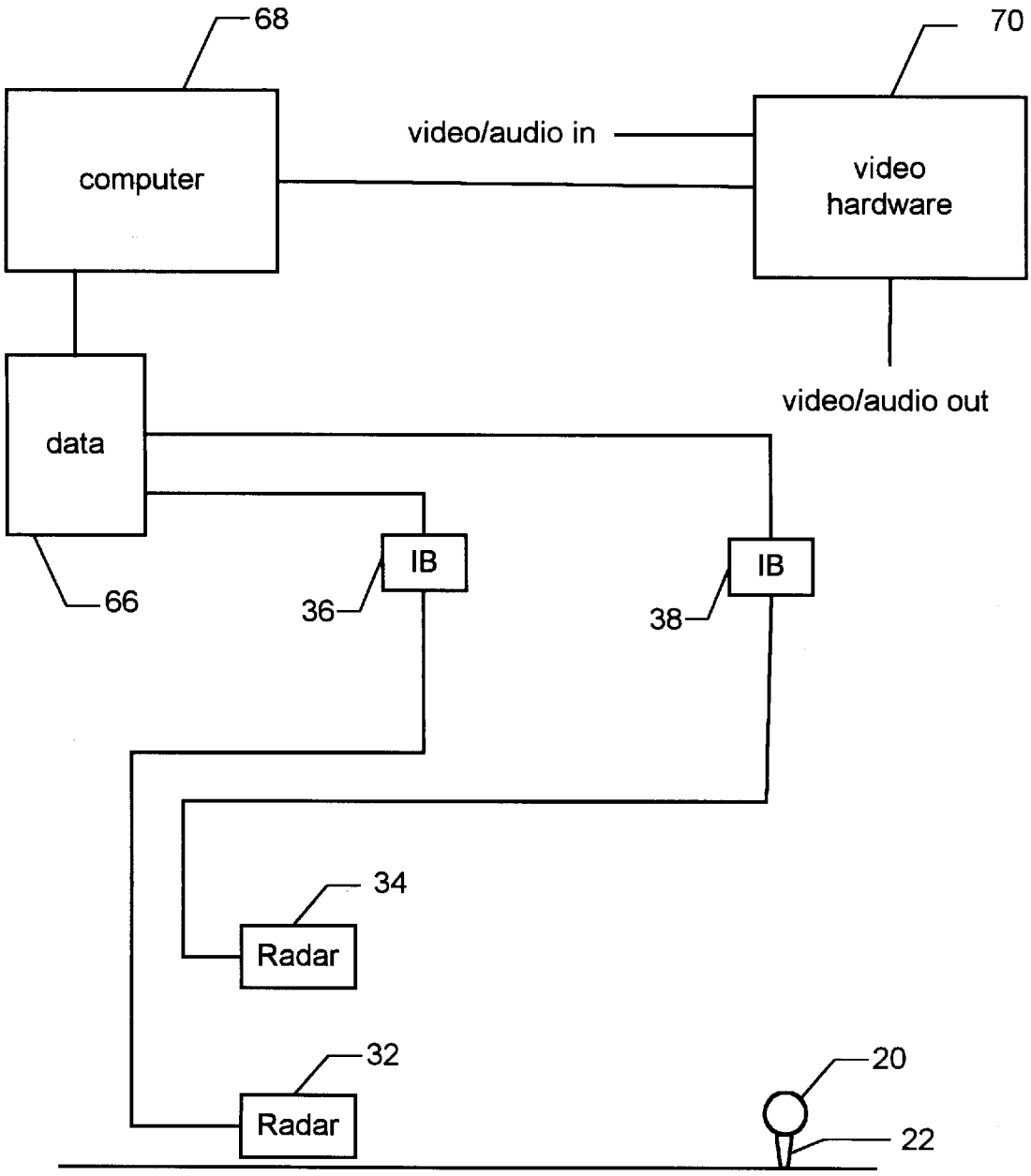
FIG. 1 is a block diagram of one embodiment of the present invention.

FIG. 1 is a block diagram of one exemplar embodiment of the present invention. Depicted in FIG. 1 is a golf ball 20 resting on a golf tee 22. Golf tee 22 is inserted in the grass of a golf course. Although golf tee 22 is depicted, it is optional. Two radar units 32 and 34 are positioned behind and pointed at golfball 20. Instead of being behind ball 20, the two radars can be at a different location pointed at ball 20. In one embodiment, radar 32 is positioned on the ground and radar 34 is positioned above the ground. In one embodiment, radar 34 is six feet above the ground. Other heights can also be used. In one embodiment, radars 32 and 34 are fifteen feet from ball 20. Other distances can also be used. It is preferable that the radars are pointed at the ball and generally along the expected path of the ball. FIG. 1 shows two radar units. The system can operate with more or less than two radar units. In one embodiment, the system can operate with one radar unit.

Various radar units can be used with the present invention. In one embodiment, the present invention uses a Doppler radar unit in order to measure velocity information and timing information of various objects. One embodiment of the present invention uses a Stalker Dual DSR Moving Radar from Applied Concepts, Inc., 730 F Avenue, Suite 200, Plano, Tex. 75074. The Stalker radar system is typically sold as a complete radar system for measuring the speed of objects. The present invention will only utilize what is called the antenna unit portion of the Stalker radar system. The antenna unit is basically a radar transmitter/receiver that operates in the Ka-band from 33.4 to 36.0 GHz. Other Doppler radar units can also be used. The Stalker DSR uses complex sampling so that incoming and outgoing Doppler shifts show up on opposite sides of zero in a complex FFT. It is possible to use a radar with real sampling that does not distinguish between incoming and outgoing Doppler shifts.

It is well known that if either the source of a radar signal or the observer of the radar signal is in motion, an apparent shift in the radar return frequency will result. This is the Doppler effect. If R is the distance from the radar to the target, the total number of wavelengths $\lambda$ contained in the two-way path between the radar and the target is $2R/\lambda$. The distance R and the wavelength $\lambda$ X are assumed to be measured in the same units. Since one wavelength corresponds to an angular excursion of $2\pi$ radians, the total angular excursion $\Phi$ made by the electromagnetic wave during its transit to and from the target is $4\pi R/\lambda$ radians. If the target is in motion, R and the phase $\Phi$ are continually changing. A change in $\Phi$ with respect to time is equal to a frequency. This is the Doppler angular frequency $W_d$, given by $$W_d = 2\pi f_d = \frac{d\Phi}{dt} = \frac{4\pi}{\lambda}\frac{dR}{dt} = \frac{4\pi V_r}{\lambda}$$

where $f_d$=Doppler frequency shift $V_r$=relative (or radial) velocity of target with respect to the radar unit The Doppler frequency shift is $$f_d = \frac{2V_r}{\lambda} = \frac{2V_r f_0}{c}$$

where $f_0$=transmitted frequency c=velocity of propagation=$3\times10^8$ m/sec and $$V_r = \frac{f_d c}{2f_0}$$

Thus, a Doppler radar can be used to measure speed.

Each radar unit is connected to an interface board. Radar unit 32 is connected to interface board 36 and radar unit 34 is connected to interface board 38. The interface boards provide a clock signal to the radar units and receive the data from the radar units. The interface boards convert the data from the radar units into a differential data format to send over a long wire at a high band width. Each of the interface boards is connected to data concentrator 66. Data concentrator 66 sends a timing signal to each interface board in order for the interface board to provide the clock signal to the respective radar units. Additionally, data concentrator 66 converts and packages the data received from the interface boards to a format readable and expected by computer 68. Data concentrator 66 communicates the data to computer 68. In one embodiment, data concentrator 66 is a computer. In another embodiment, it is a custom electronic design which may include a processor.

In one embodiment, computer 68 includes a Pentium II 450 MHZ processor. In alternative embodiments, computer 68 can include a different processor or can utilize multiple processors. Computer 68 can also include RAM, a hard drive, a floppy disk, a display, a keyboard, a printer, a pointing device, a CD-ROM unit, a modem and/or a network interface. Computer 68 processes the information received from data concentrator 66 and determines the speeds and other information in question. Computer 68 includes software for providing a graphical user interface (GUI) to inform a user of the results of the processes. Additionally, the GUI can be used to allow an operator to configure, test and/or operate the system. Computer 68 reports the results of its processes to a client. The results are typically reported in event records. An event record could include the type of event, the timing of the event and measured speed(s). Computer 68 may also receive time codes from a broadcaster of a sporting event or another source for synchronization purposes. The system can also use the internal clock of computer In one embodiment, computer 68 sends the event records to a broadcaster or other information gatherer. In one alternative, computer 68 stores the data for later use or sends the data directly to a web page on the Internet. In another embodiment, computer 68 sends the event records to video hardware 70. Video hardware 70 can be any hardware that takes the information from computer 68 and edits the video of the event (e.g. golf tournament) to add the information from computer 68 into the video. For example, video hardware 70 can be a computer which receives the information from computer 68 and a video signal and/or an audio signal. The computer of video hardware 70 can add a graphic or text to the video to display the information of the event record (e.g. club speed, ball speed, etc.). Alternatively, prestored audio or synthesized audio can be used to add an audio indication of the event (e.g. club speed, ball speed, etc.). In another embodiment, video hardware 70 can include a keyer and a graphics generator. A graphics generator can create a graphic which displays the information contained in the event record and a keyer can be used to blend the graphic with the video of the golf tournament. One example of a graphics generator is a computer such as an O2 Workstation from Silicon Graphics. Another alternative is to use a Chyron machine to insert text or graphics into video. The resulting video is then transmitted for either broadcasting, recording or other display purposes. In yet another embodiment, the results of computer 68 can be printed or displayed on a monitor for use by statisticians, the broadcast announcers, coaches, players or fans.

Figure 2:
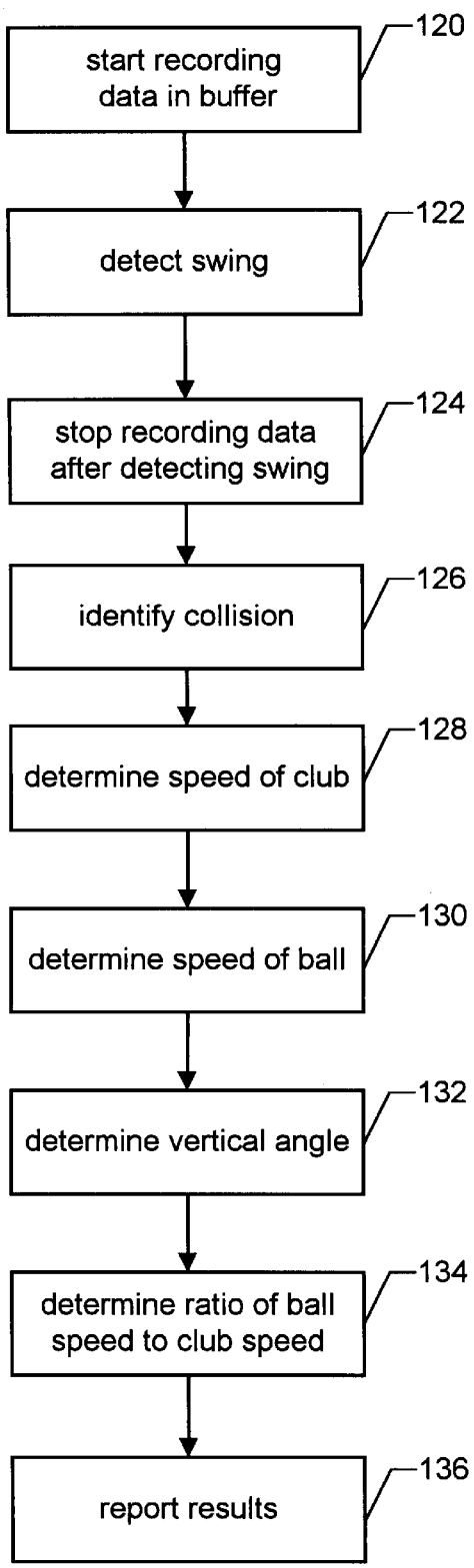
FIG. 2 is a flow chart describing the method of operation of one embodiment of the present invention.

FIG. 2 is a flow chart which explains the method of operation of one embodiment of the present invention. In step 120, the system begins recording time domain data samples in a buffer. That is, the radar units are transmitting and receiving radar information which is being processed by interface boards 36 and 38 and data concentrator 66. The data is packaged together by data concentrator 66 and sent to computer 68 which stores the data in a circular buffer. Data continues to be sensed by the radars and recorded in the circular buffer until step 124. In one embodiment, even after the data is no longer being recorded in the circular buffer, the radar units are still sensing new data.

In step 122, the system detects a club swing. That is, computer 68 executes a loop which accesses the data in the circular buffer and attempts to determine whether the data in the buffer indicates a club swing. Step 122 is continuously performed until a club swing is detected.

After the club swing is detected, computer 68 continues to record data in the circular buffer for an additional 0.2 seconds (step 124). Additionally, the buffer will also store data for up to 0.1 seconds before the detected club swing. In step 126, computer 68 identifies the data which represents the collision of the club hitting the ball. In step 128, the system determines the speed of the club. In one embodiment, the system determines the fastest speed of the club during the swing. In another embodiment, the system determines the speed of the club when the club hits the ball. In this latter embodiment, step 128 is based on identifying the collision in step 126. In another embodiment, the system can determine the club speed at various times during the swing. In step 130, the system determines the speed of the ball. In one embodiment, the system determines the speed of the ball just after being hit. In another embodiment, the system determines the speed of the ball at other times after being hit. In step 132, the system determines the vertical angle of the path of the ball. In step 134, the system determines the ratio of the ball speed to the club speed. In one embodiment, step 134 includes dividing the speed determined in step 130 by the speed determined in step 128.

The system need not perform all of steps 128, 130, 132 and 134. One or more, or any other subset of those steps can be performed. Additionally, the order of the steps of FIG. 2 can be rearranged within the spirit of the present invention.

In step 136, computer 68 reports the results of the previous steps. Reporting the results could include providing any of the information from steps 126–134 to a monitor, to a printer, to a broadcast video character generator, to another function, to another process, to a disk, to another computer, to other hardware, etc. As described with respect to FIG. 1, the information can be stored as part of an event record which, in one embodiment, is communicated to a broadcaster of the baseball event or to a coach, player or fan. The steps of FIG. 2 are performed by computer 68. In one embodiment, computer 68 is a general purpose computer programmed with software to perform the steps described herein. In another embodiment, computer 68 can be a special purpose computer designed specifically to perform the described steps.

Figure 3:
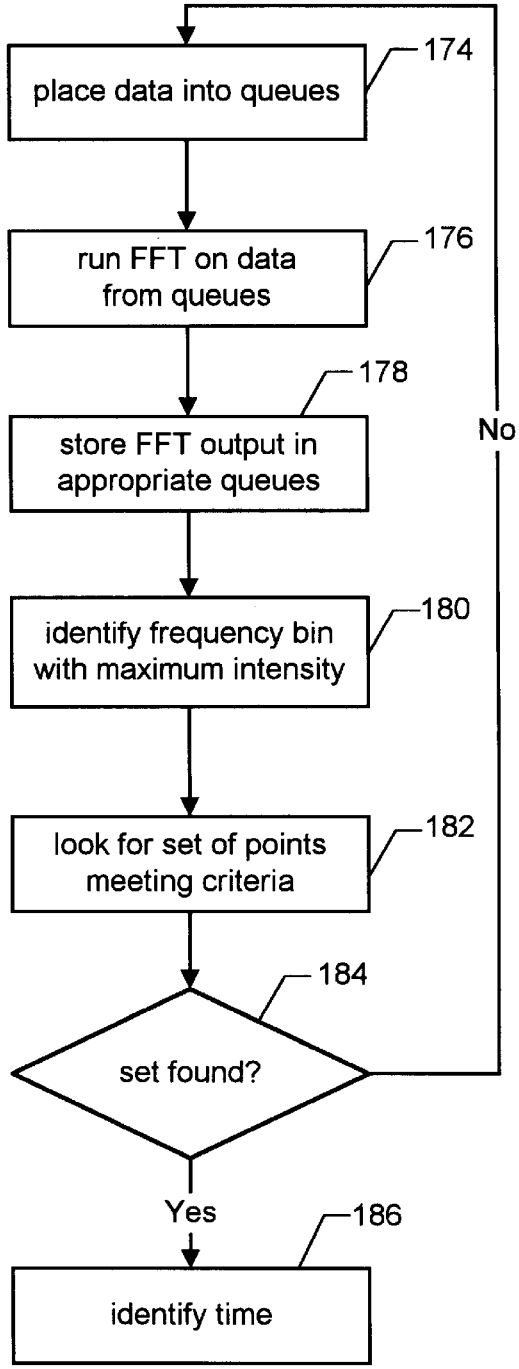
FIG. 3 is a flow chart describing the method of detecting a swing.
Figure 4:
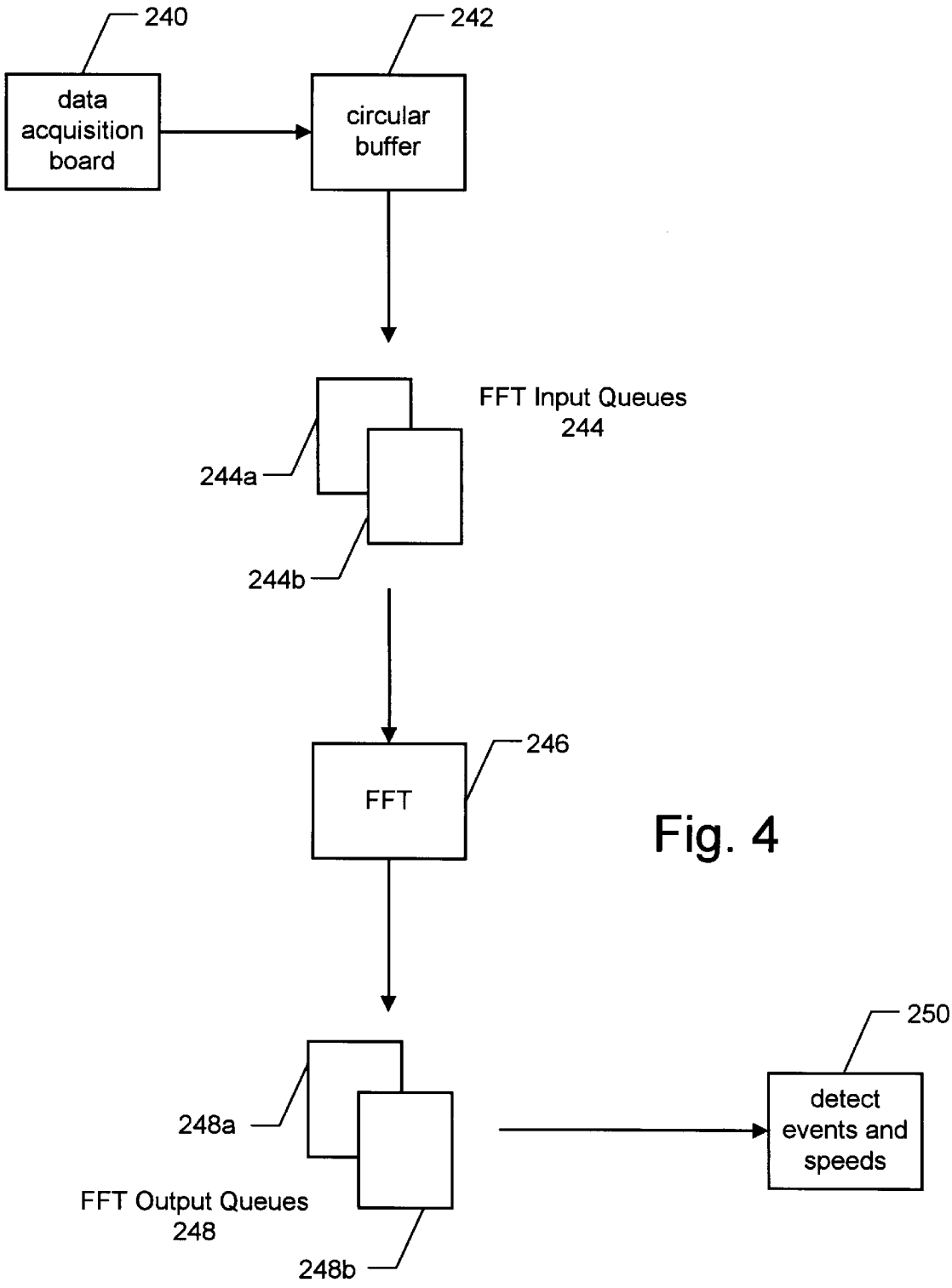
FIG. 4 shows the flow of data for one embodiment of the present invention.

FIG. 3 is a flow chart describing the method for detecting a club swing. In step 174, data received by computer 68 from data concentrator 66 is placed into a set of queues. FIG. 4 shows the flow of data for one embodiment of the present invention. Everything depicted in FIG. 4 takes place within computer 68. Data received by computer 68 from data concentrator 66 is first received by a data acquisition board 240 inside computer 68. In one embodiment, data acquisition board 240 is a 6533 (DIO-32HS) high speed, parallel digital I/O interface for PCI, PX Compact PCI, PCMCIA and ISA computers, manufactured by National Instruments Corporation. Other boards can also be used. The data received by data acquisition board 240 is sent to circular buffer 242. In one embodiment, circular buffer 242 includes two megabytes of RAM. In one embodiment, data is stored in the circular buffer in 128K samples per channel. Computer 68 also maintains a set of FFT input queues 244 such that there is one input queue per radar unit. Thus, in the embodiment of FIG. 1, queues 244 includes two separate queues 244*a* and 244*b*. Step 174 of FIG. 3 includes moving data from circular buffer 242 into the appropriate FFT input queue 244. For example, data from radar unit 32 is stored in FFT input queue 244*a* and data from radar unit 34 is stored into FFT input queue 244*b*. In one embodiment, the radar units used are phase quadrature radar units. Thus, each queue will store Q data and I data for each radar along with status data and synchronization data. In one embodiment, step 174 includes placing 512 digital data samples into the FFT input queue(s) the first time step 174 is performed. At each subsequent instance that step 174 is performed the newest 128 samples will be moved to the appropriate FFT input queue.

In step 176, computer 68 runs a Fast Fourier Transform (FFT) on data in both of the queues. In one alternative, the system performs a full Fourier Transform, rather than an FFT. However, the FFT requires less computing power and is still considered a Fourier Transform. In an alternative embodiment, rather than using a Fourier Transform, the system uses another frequency-time resolution algorithm. In one embodiment, the FFT of step 176 is performed on data from only one radar unit. FIG. 4 shows step 176 being performed by FFT software module 246. In step 178, the output of FFT module 246 is stored in FFT output queues 248, such that there is one queue for each radar unit similar to the FFT input queues 244. Data for radar unit 32 is stored in queue 248*a* and data for radar unit 34 is stored in queue 244*b*. The data in the FFT output queues are used by the software for detecting events and determining speeds as described below.

Figure 5:
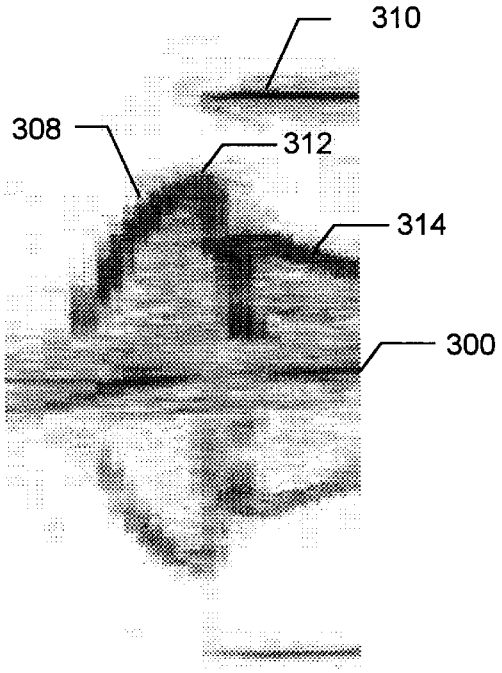
FIG. 5 is a graphical representation of data from a radar unit after a Fast Fourier Transform (FFT).

FIG. 5 depicts data from one radar after an FFT has been performed. The horizontal axis of the graph represents time and the vertical axis of the graph represents frequency. The intensity of each pixel in the graph is proportional to the amplitude of the signal received for the particular time and frequency data. Reference 300 approximates the zero speed or frequency shift line. Data below the zero line represents negative speed (e.g. an object moving towards the radar unit) and data above the zero line represents positive speed (e.g. an object moving away from the radar unit). The ramp of data noted by reference 308 represents the movement of the club. Line of data 310 represents the ball moving from the tee. Reference 312 shows an approximation of the collision time. Reference 314 represents movement of the club after the collision.

Figure 6:
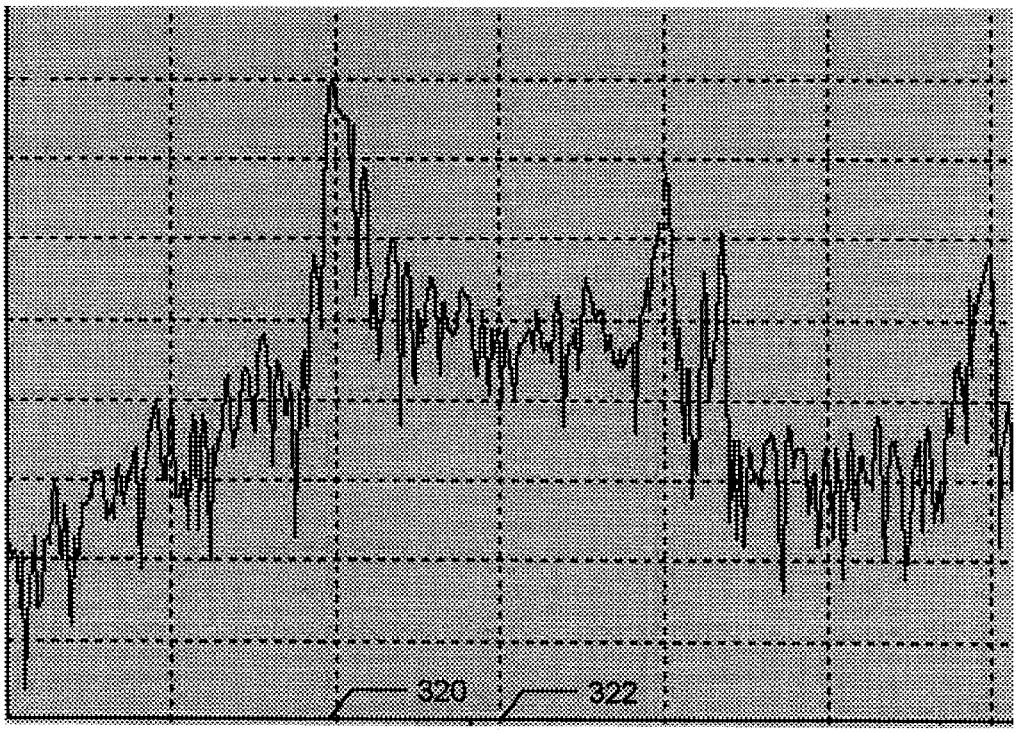
FIG. 6 is a graphical representation of one time slice of data from a graph like that of FIG. 5.

FIG. 6 shows data for one time slice of the graph of FIG. 5. The horizontal axis of FIG. 6 represents frequency and the vertical axis of FIG. 6 represents intensity. The vertical line at reference 322 represents zero speed or Doppler frequency shift. Reference 320 identifies the Doppler frequency shift having the peak radar return.

At an interval of 128 samples, the next 512 samples are provided to FFT computation block 246. The output of FFT computation block 246 is 512 frequency bins, where 256 frequency bins represent negative speed and 256 frequency bins represent positive speed (away from the radar unit). FIG. 5 shows a collection of the outputs of FFT computation block 246. For each point along the horizontal axis of FIG. 5, one FFT output is plotted vertically. This is called a time slice. The top most point of a time slice of FIG. 5 represents the maximum positive frequency. The bottom most point of the time slice of FIG. 5 represents the negative maximum negative frequency. The intensity of each point represents the amount of radar energy returned at that frequency. FIG. 6 plots frequency versus intensity for a time slice.

Looking back at FIG. 3, step 180 includes looking at the 256 positive frequency bins of the time slice from the output of step 176. For the FFT output sample (or time slice) under consideration, computer 68 chooses the frequency bin corresponding the to the maximum (or peak) intensity value measured. For example, step 180 includes looking at data like that of FIG. 6 and finding the frequency (horizontal axis) associated with the highest intensity value (vertical axis). The output of step 180 is one point (intensity, frequency). Looking at FIG. 6, this would be the frequency designated by reference 320. In one embodiment, step 180 includes only looking at intensity values in a subwindow of frequencies. One suitable subwindow includes frequencies corresponding to 25 mph–120 mph.

In step 182, computer 68 looks for a set of the points that meet a club swing criteria. One example of suitable criteria is to find a set of points of the data points identified in the current and previous iterations of step 180 such that a set of N (e.g. 3) consecutive points are greater than a speed threshold and greater than an intensity threshold. One example of a speed threshold is 35 mph. The intensity threshold should be determined based on trial and error in order to distinguish good data from noise for the particular hardware and environment.

If a set of data points meeting the criteria is found (step 184), then computer 68 proceeds to step 186 and identifies the earliest time slice in the data set found in step 182. That is, each data point is associated with a time slice (output of step 176). Each time slice is created by taking an FFT of 512 samples. The time of the time slice is the time associated with the $256^{th}$ sample of the FFT slice. The slice identified in step 186 represents the first detection of the club swinging away from the radar. If in step 184 it is determined that a set of points matching the criteria was not found, then the system loops back to step 174 and repeats step 174–182 on a new grouping of data. In one embodiment, the next iteration of steps 174–182 can be performed on a group of data that overlaps with the previous group of data. For example, when the system loops back to step 174, 128 new samples are placed into the queue. The FFT of step 176 is performed using the new 128 samples and the previous 384 samples.

For purposes of performing step 122 (detecting a swing) of FIG. 2, it is only necessary to perform the method of FIG. 3 on data for one radar. However, the method of FIG. 3 is performed for all radars and the time identified in step 186 (also called the trigger time) is used for later calculations.

Once the club swing is determined and, consequently, the data representing the club swing is identified, determining the speed of the club swing at any given time is accomplished by analyzing the data like that of FIG. 5. For example, the speed of the club during a swing for a given time is represented by ramp 308. Computer 68 can access the data for a particular time slice associated with the time of interest and read the frequency data to determine speed. In one embodiment, the frequency associated with the peak intensity for the time slice under consideration is used to determine speed.

Figure 7:
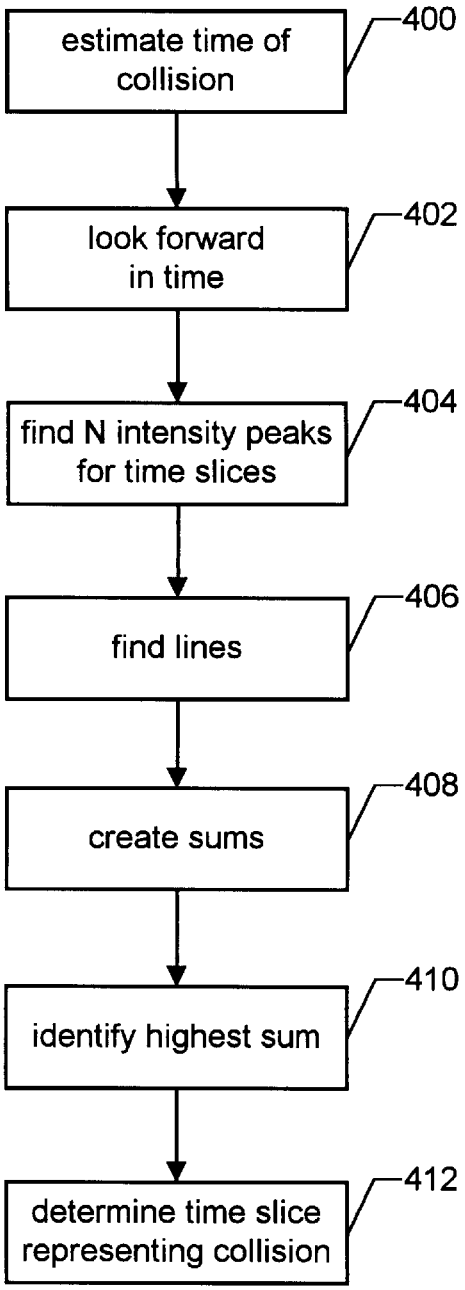
FIGS. 7 and 8 depict flow charts describing portions of the operation of one embodiment of the present invention.

FIG. 7 is a flow chart describing one embodiment of the steps performed after the method of FIG. 3. The method of FIG. 7 is performed for each radar unit. In step 400, an estimate is made of the time the club collided with the ball. The system loops through all of the FFT data for one radar and determines the time slice where the intensity for the maximum number of frequency bins in a window is over a threshold. The system establishes a window in speed (frequency) and time space. An example of a window is between 25–100 mph and three time slices wide. For each window position in time, the system determines the number of frequency bins in this window where the intensity is over a threshold (e.g. 20 dB). The system slides this window in time, one slice at a time, and finds the time slice where there is a maximum of frequency bins with an intensity over the threshold. After the system determines the time slice with the maximum, the system stores the time for that time slice as the estimated collision time as seen by the radar unit that is the source of the FFT data.

In step 402, the system begins to look for data representing the movement of the ball. For data from a given radar, the system looks forward in time from the estimated collision time for that given radar. In one embodiment, the system looks forward in time for 0.04 seconds from the estimated collision determined in step 400. In step 404, the system looks for the P highest intensity peaks for each time slice in the set of data considered in step 402. Thus, in one embodiment, the system can look for the ten highest intensity peaks for each time slice in the 0.04 seconds after the collision reference point. In one embodiment, each time slice is about three milliseconds. The intensities identified in step 404 could represent the ball, the club follow-through, reflections of the club, reflections of the ball, noise or something else. In step 406, the system finds lines of data from the peaks identified in step 404. Optimally, the system finds straight lines. However, in the real world, the system looks for data that is close to straight lines. One method for performing step 406 is to look for intensity peaks (from the set of peaks found in step 404) in consecutive time slices that are associated with speed values that are relatively close in value to each other or identical to each other. That is, the speed values at the intensity peaks of step 404 are close to each other or identical. It is likely that step 406 will identify multiple lines of various lengths. Each of these lines will consist of points having an intensity value and an associated frequency. In step 408, the system will add up the intensity values for each point on a given line. Thus, a sum of intensity values will be created for each line.

In step 410, the system determines the line with the highest sum of intensity values. The line identified in step 410 is assumed to be the line of data representing the movement of the ball. In step 412, the system more accurately identifies the collision point. In one embodiment, step 412 includes considering each point along the line identified in step 410 representing the movement of the ball. The system looks for a difference of intensity values between two consecutive data points that is greater than a threshold and where the intensity of the data point that is later in time is greater than the intensity of the data point that is earlier in time. One example of a suitable threshold is 20 dB. The change of intensity values between two consecutive data points greater than the threshold represents the start of the ball moving and indicates a refined collision time of the club hitting the ball. The point in time after the change of intensity values is considered the refined collision time as determined by the radar under consideration.

Figure 8:
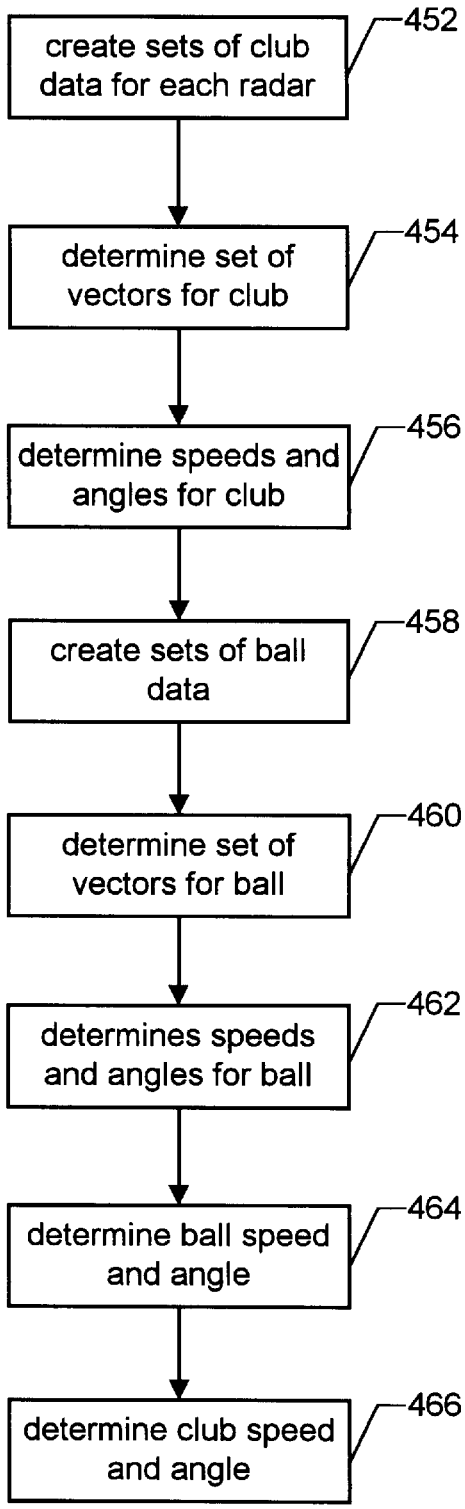

After the method of FIG. 7 is performed for each radar, the system has a refined collision time for each radar and ball data (lines of data) for each radar. At this point, the method of FIG. 8 is performed. In step 452, the system creates sets of club data for each radar. For each radar unit, the system looks at X time slices after the trigger point for the respective radar. In one embodiment, the system looks at twenty time slices after the trigger time. For each time slice considered the system stores the frequency having the greatest intensity (e.g. frequency 320 of FIG. 6). Thus after step 452, the system has stored twenty data points for each radar, where each data point includes a time and a frequency.

In step 454, the system determines a set of velocity vectors for the golf club. To do this, the system loops through the data created in step 452 and identifies all of the time slices where there is data from step 452 for both radars and computes velocity vectors for these time slices.

Data from two (or more) radars can be used to determine a two dimensional velocity vector for the club or the ball. If the position and the velocity vector of the ball or club is determined at one or more times, an estimate of the trajectory and the path of the ball or club can also be determined. One method for determining the velocity vector of the ball or club using data from two radars is to solve equations based on the measured speed of the ball or club from the two radars.

Assume that the ball or club is at the origin of a coordinate system (x=0, y=0, z=0)

Let $R_1$ =Unit vector of radar 1 in the direction of the ball or club head

Let $R_2$ =Unit vector of radar 2 in the direction of the ball or club head

Let V =Velocity vector of the ball or club ($V_y$, $V_z$)

Let $V_1$ =Speed of ball or club measured at radar 1 (based on Doppler frequency)

Let $V_2$ =Speed of ball or club measured at radar 2 (based on Doppler frequency)

The velocity of the ball or club measured by a radar is equal to the dot product of the velocity vector and the unit vector. So:

$$V_1 = R_1 \cdot V$$

$$V_2 = R_2 \cdot V$$

$$\begin{bmatrix} V_1 \\ V_2 \end{bmatrix} = \begin{bmatrix} R_{1y} & R_{1z} \\ R_{2y} & R_{2z} \end{bmatrix} \cdot \begin{bmatrix} V_y \\ V_z \end{bmatrix}$$

$$\begin{bmatrix} V_y \\ V_z \end{bmatrix} = \begin{bmatrix} R_{1y} & R_{1z} \\ R_{2y} & R_{2z} \end{bmatrix}^{-1} \cdot \begin{bmatrix} V_1 \\ V_2 \end{bmatrix}$$

Using these equations, computer 68 can solve for the velocity vector V since $R_1$ and $R_2$ are known and $V_1$ and $V_2$ are measured by the radars.

For each velocity vector determined in step 454, the system determines the club speed and the vertical angle of the path of the club in step 456. The speed of the club is determined by the following equation:

$$\text{speed} = \sqrt{V_{y^2+V_z^2}}$$

The vertical angle of the path of the ball (or club) is determined by the following equation:

$$angle = a\tan\left(\frac{V_z}{V_y}\right)$$

In step 456, the system stores an array of records, where each record includes a time, a velocity vector, a speed and an angle.

In step 458, the system creates sets of ball data for each radar. For each radar unit, the system looks at Y time slices after the refined collision time for the respective radar. In one embodiment, the system looks at eleven time slices after is the refined collision time. For each time slice considered the system stores the frequency having the greatest intensity (e.g. frequency 320 of FIG. 6). Thus after step 458, the system has stored eleven data points for each radar, where each data point includes a time and a frequency.

In step 460, the system determines a set of velocity vectors for the ball. To 20 do this, the system loops through the data stored in step 458 and identifies all of the time slices where there is data from step 458 for both radars and computes velocity vectors for these time slices. The vectors are computed as described above with respect to the club. For each vectors determined in step 460, the system determines the ball speed and the vertical angle of the path of the ball in step 462 using the equations discussed above with respect to the club. In step 462, the system has stores an array of records, where each record includes a time, a velocity vector, a speed and an angle.

In step 464, the system determines the ball speed and angle to report. In one embodiment, the system looks for the ball velocity vector that is earliest in time. The time associated with that vector is declared to be the final collision time. The speed and angle associated with that vector are reported as the ball speed and ball vertical angle. In one embodiment, the final collision time can also be reported.

The club speed is determined in step 466 by looking at the time slice that is two time slices prior to the final collision time. Of the array of speed and angles determined in step 456, the speed and angle closest in time to the time slice that is two time slices prior to the final collision time are reported as the club speed and club vertical angle.

The foregoing detailed description of the invention has been presented for purposes of illustration and description. It is not intended to be exhaustive or to limit the invention to the precise form disclosed, and obviously many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A method of determining speed of a golf club and a golf ball using at least two radar units, comprising the steps of:

receiving radar data from said two radar units;

identifying a swing of said golf club;

determining a moment said golf club hit said golf ball;

determining said golf ball's speed after being hit;

determining said golf club's speed during said golf club swing;

determining an angle of a path of said golf ball; and reporting said angle, said golf club's speed during said golf club swing and said golf ball's speed after being hit.

2. An apparatus for determining a speed of a golf club and a speed of a golf ball, comprising:

a first radar unit;

a second radar unit;

a first interface connected to said first radar unit;

a second interface connected to said second radar unit;

means for determining golfball speed in communication with said first interface and said second interface; and means for determining golf club speed in communication with said first interface and said second interface.

3. A method for determining speed information for a golf club using radar, comprising the steps of:

accessing radar data for multiple moving objects, said radar data is from a set of two or more radar units, said multiple moving objects include said golf club;

identifying a subset of said radar data pertaining to said golf club during a swing; and determining a speed of said golf club during said swing based on said subset of said radar data.

4. A method according to claim 3, further comprising the steps of:

receiving information from said radar units; and processing said information using a frequency-time resolution algorithm, said radar data is a result of said frequency-time resolution algorithm.

5. A method according to claim 3, wherein:

said step of determining includes determining a speed of said golf club at a moment when said golf club hits a ball.

6. A method according to claim 3, wherein:

said step of determining includes determining a maximum speed of said golf club during said swing.

7. A method according to claim 3, further comprising the step of:

detecting said swing using said radar data, said step of determining is performed in response to said step of detecting said swing.

8. A method according to claim 7, wherein said step of detecting said swing includes the steps of:

performing a frequency-time resolution algorithm on at least a subset of said radar data;

identifying frequency bins with a maximum intensity;

identifying a set of points from said frequency bins meeting predefined swing criteria; and identifying which point from said set of points is earliest in time, said point earliest in time represents a detection of said swing.

9. A method according to claim 3, further comprising the step of:

detecting when said golf club hit a golfball using said radar data, said step of determining a speed of said golf club includes the steps of:

creating sets of club data for said two radar units that identify frequencies having a highest intensity for a set of time slices, determining a set of velocity vectors for said club based on said identified frequencies for time slices that include data from both of said two radar units, determining speeds for said club for each velocity vector, and determining an impact speed by identifying a speed that is associated with a velocity vector that is associated with a time near and prior to a time said golf club hit said golf ball.

10. A method according to claim 3, further comprising the step of:

detecting when said golf club hit a golf ball using said radar data, said step of detecting when said golf club hit a golf ball includes the steps of:

estimating a time of collision, identifying a set of highest intensity peaks for a group of time slices that are forward in time from said estimated time of collision and within a predetermined time window from said estimated time of collision, identifying approximations of lines formed by said peaks, determining which line has a highest sum of intensity values, and determining a refined time of collision by identifying two points on said line having said highest sum that differ in intensity values by at least a threshold amount, said refined time of collision is a later in time point of said two points.

11. A method according to claim 3, further comprising the steps of:

detecting when said golf club hit a golf ball; and determining a speed of said golf ball after said golf club hits said golf ball based on said radar data from at least two radar units.

12. A method according to claim 11, wherein said step of determining a speed of said golf ball includes the steps of:

creating sets of club data for said at least two radar units that identify frequencies having a highest intensity for a set of time slices;

determining a set of velocity vectors for said ball based on said identified frequencies for time slices that include data from said at least two radar units; and determining a post impact speed by identifying a speed that is associated with a velocity vector that is associated with a time near and subsequent to a time said golf club hit said golfball.

13. A method according to claim 12, further comprising the step of:

determining an angle of a path of said golf ball.

14. A method according to claim 11, further comprising the step of: reporting said speed of said golf ball and said speed of said golf club.

15. A method according to claim 11, further comprising the step of: determining and reporting a ratio of said speed of said golf club to said speed of said golf ball.

16. A method for determining speed information for a golfball using radar, comprising the steps of:

accessing radar data for multiple moving objects, said radar data is from a set of two or more radar units, said multiple moving objects include said golf ball;

identifying a subset of said radar data from at least two radar units pertaining to said golf ball; and determining a speed of said golf ball based on said subset of said radar data.

17. A method according to claim 16, further comprising the steps of:

receiving information from said radar units; and processing said information using a frequency-time resolution algorithm, said radar data is a result of said frequency-time resolution algorithm.

18. A method according to claim 16, wherein:

said step of determining includes determining a moment when a golf club hits said golf ball and determining a speed of said golf club at said moment when said golf club hits said golf ball.

19. A method according to claim 16, further comprising the step of:

detecting when a golf club hit said golf ball, said step of determining is performed in response to said step of detecting.

20. A method according to claim 19, wherein said step of detecting when said golf club hit said golf ball includes the steps of:

estimating a time of collision;

identifying a set of highest intensity peaks for a group of time slices that are forward in time from said estimated time of collision and within a predetermined time window from said estimated time of collision;

identifying approximation of lines formed by said peaks;

determining which line has a highest sum of intensity values; and determining a refined time of collision by identifying two points in said line having said highest sum that differ in intensity value by at least a threshold amount, said refined time of collision is a later in time point of said two points.

21. A method according to claim 20, wherein said step of determining a speed of said golf ball includes the steps of:

creating sets of data for at least two radar units that identifies frequencies having a highest intensity for a set of time slices, determining a set of velocity vectors for said ball based on said identified frequencies for time slices that includes data from both of said at least two radar units;

determining speeds for said ball for each velocity vector; and determining a post impact speed by identifying a speed that is associated with a velocity vector that is associated with a time near and subsequent to a time said golf club hit said golfball.

22. A method for determining information about a golf ball using radar information, comprising the steps of:

accessing radar data for multiple moving objects, said radar data is from a set of two or more radar units, said multiple moving objects include said golf ball;

identifying a subset of said radar data from at least two radar units pertaining to said golf ball; and determining said angle of a path of said golf ball based on said subset of said radar data.

23. A method according to claim 22, further comprising the steps of:

receiving information from said radar units; and processing said information using a frequency-time resolution algorithm, said radar data is a result of said frequency-time resolution algorithm.

24. A method according to claim 22, further comprising the step of:

detecting when a golf club hits said golfball, said step of determining said angle is based on said step of detecting.

25. A method according to claim 24, wherein said step of detecting when said golf club hit said golf ball includes the steps of:

estimating a time of collision;

identifying a set of highest intensity peaks for a group of time slices that are forward in time from said estimated time of collision and within a predetermined time window from said estimated time of collision;

identifying approximation of lines formed by said peaks;

determining which line has a highest sum of intensity values; and determining a refined time of collision by identifying two points in said line having said highest sum that differ in intensity value by at least a threshold amount, said refined time of collision is a later in time point of said two points.

26. A method for determining a velocity of a golf club, comprising the steps of:

accessing radar data for said golf club, said radar data is based on measurements of two or more radar units;

identifying a first subset of radar data from a first radar unit, said first subset of radar data pertains to rate of movement of said golf club during a swing;

determining a first speed value for said golf club based on said first subset of radar data;

identifying a second subset of radar data from a second radar unit, said second subset of radar data pertains to rate of movement of said golf club during said swing;

determining a second speed value for said golf club based on said second subset of radar data; and determining said velocity of said golf club based on said first speed value and said second speed value.

27. A method according to claim 26, wherein:

said step of determining a first speed value includes determining a speed of said golf club at a moment when said golf club hits a ball.

28. A method according to claim 26, wherein:

said step of determining a first speed value includes determining a maximum measured speed of said golf club during said swing.

29. A method according to claim 26, further comprising the step of:

detecting said swing using said radar data, said step of determining a first speed value is performed in response to said step of detecting said swing.

30. A method according to claim 29, wherein said step of detecting said swing includes the steps of:

performing a frequency-time resolution algorithm on said radar data;

identifying frequency bins with a maximum intensity;

identifying a set of points from said frequency bins meeting predefined swing criteria; and identifying which point from said set of points is earliest in time, said point earliest in time represents a detection of said swing.

31. A method according to claim 26, further comprising the step of:

detecting when said golf club hit a golf ball using said radar data, said step of determining a first speed value includes the steps of:

creating sets of club data for said first radar unit and said second radar unit that identify frequencies having a highest intensity for a set of time slices, and determining a set of speed information for said club based on said identified frequencies for time slices that include data from said first radar unit and said second radar unit.

32. A method according to claim 26 further comprising the step of:

detecting when said golf club hit a golf ball using said radar data, said step detecting when said golf club hit a golf ball includes the steps of:

estimating a time of collision, identifying a set of highest intensity peaks for a group of time slices that are forward in time from said estimated time of collision and within a predetermined time window from said estimated time of collision, identifying approximations of lines formed by said peaks, determining which line has a highest sum of intensity values, and determining a refined time of collision by identifying two points on said line having said highest sum that differ in intensity values by at least a threshold amount, said refined time of collision in a later in time point of said two points.

33. A method according to claim 26, further comprising the steps of:

detecting when said golf club hit a golf ball; and determining a velocity of said golf ball after said golf club hits said golf ball based on said radar data.

34. A method according to claim 33, further comprising the step of:

determining an angle of a path of said golf ball.

35. A method according to claim 33, further comprising the step of:

reporting at least a component of said velocity of said golf ball and said velocity of said golf club.

36. A method according to claim 33, further comprising the step of:

determining and reporting a ratio of speed of said golf club to speed of said golf ball.

37. A method according to claim 26, wherein:

said first radar unit and said second radar unit are Doppler radar units.

38. A method according to claim 26, wherein:

said first radar unit and said second radar unit measure radial rate information.

39. A method for determining a velocity of a golfball, comprising the steps of:

accessing radar data for said golf ball, said radar data is based on measurements of two or more radar units;

identifying a first subset of radar data from a first radar unit pertaining to rate of movement of said golf ball;

determining a first speed value for said golf ball based on said first subset of said radar data;

identifying a second subset of radar data from a second radar unit pertaining to rate of movement of said golf ball;

determining a second speed value for said golf ball based on said second subset of said radar data; and determining said velocity of said golf ball based on said first speed value and said second speed value.

40. A method according to claim 39, further comprising the step of:

detecting when a golf club hit said golf ball, said velocity pertains to movement of said golf ball after said golf club hit said golf ball.

41. A method according to claim 40, wherein said step of detecting when said golf club hit said golf ball includes the steps of:

estimating a time of collision;

identifying a set of highest intensity peaks for a group of time slices that are forward in time from said estimated time of collision and within a predetermined time window from said estimated time of collision;

identifying approximation of lines formed by said peaks;

determining which line has a highest sum of intensity values; and determining a refined time of collision by identifying two points in said line having said highest sum that differ in intensity value by at least a threshold amount, said refined time of collision is a later in time point of said two points.

42. A method according to claim 39, further comprising the step of:

determining an angle of a path of said golf ball based on said first speed value and said second speed value.

43. An apparatus for determining velocity of a golf club, comprising:

two or more radar units; and a processor in communication with said two or more radar units, said processor performs a method comprising the steps of:

accessing radar data for said golf club, said radar data is based on measurements of said two or more radar units, identifying a first subset of radar data from a first radar unit, said first subset of radar data pertains to rate of movement of said golf club during a swing, determining a first speed value for said golf club based on said first subset of said radar data, identifying a second subset of radar data from a second radar unit, said second subset of radar data pertains to rate of movement of said golf club during said swing, determining a second speed value for said golf club based on said second subset of said radar data, and determining said velocity of said golf club based on said first speed value and said second speed value.

44. An apparatus according to claim 43, wherein said method further comprising the step of:

detecting when said golf club hit a golf ball using said radar data, said step of determining a first speed value is based on said step of detecting when said golf club hit said golf ball.

45. An apparatus according to claim 43, wherein said step of determining a first speed value includes the steps of:

creating sets of club data for said first radar unit and said second radar unit that identify frequencies having a highest intensity for a set of time slices; and determining a set of speed information for said club based on said identified frequencies for time slices that include data from said first radar unit and said second radar unit.

46. An apparatus according to claim 43, wherein said method further comprises the step of:

determining a club speed based on said velocity; and reporting said club speed.

47. An apparatus according to claim 43, wherein said method further comprises the step of:

detecting when said golf club hit a golf ball using said radar data, said step of detecting when said golf club hit a golf ball comprises the steps of:

estimating a time of collision, identifying a set of highest intensity peaks for a group of time slices that are forward in time from said estimated time of collision and within a predetermined time window from said estimated time of collision, identifying approximations of lines formed by said peaks, determining which line has a highest sum of intensity values, and determining a refined time of collision by identifying two points on said line having said highest sum that differ in intensity values by at least a threshold amount, said refined time of collision is a later in time point of said two points.

48. An apparatus for determining a velocity of a golf ball, comprising:

two or more radar units; and a processor in communication with said two or more radar units, said processor performs a method comprising the steps of:

accessing radar data for said golf ball, said radar data is based on measurements of said two or more radar units, identifying a first subset of radar data from a first radar unit pertaining to rate of movement of said golf ball, determining a first speed value for said golf ball based on said first subset of said radar data, identifying a second subset of radar data from a second radar unit pertaining to rate of movement of said golf ball, determining a second speed value for said golf ball based on said second subset of said radar data, and determining said velocity of said golf ball based on said first speed value and said second speed value.

49. A method according to claim 48, wherein said method further comprises the step of:

detecting when a golf club hit said golf ball, said velocity pertains to movement of said golf ball after said golf club hit said golf ball.

50. A method according to claim 49, wherein said step of detecting when said golf club hit said golf ball includes the steps of:

estimating a time of collision;

identifying a set of highest intensity peaks for a group of time slices that are forward in time from said estimated time of collision and within a predetermined time window from said estimated time of collision;

identifying approximation of lines formed by said peaks;

determining which line has a highest sum of intensity values; and determining a refined time of collision by identifying two points in said line having said highest sum that differ in intensity value by at least a threshold amount, said refined time of collision is a later in time point of said two points.

51. An apparatus according to claim 48, wherein said method further comprises the steps of:

determining a velocity of a golf club, said golf club hits said golf ball, said velocity of said golf ball pertains to after said golf club hits said golf ball; and determining and reporting a ratio of at least a component of said velocity of said gold club to at least a component of said velocity of said golf ball.

52. An apparatus according to claim 48, wherein said method further comprises the step of:

determining an angle of a path of said golf ball based on said first speed value and said second speed value.

53. A method according to claim 3, wherein:

said step of determining a speed includes determining a velocity of said golf club during said swing based said identified subset of said radar data, said speed of said golf club is determined based on said velocity.

54. A method according to claim 16, wherein:

said step of determining a speed includes determining a velocity of said golf ball based said identified subset of said radar data, said speed of said golf ball is determined based on said velocity.

55. A method according to claim 22, wherein:

said step of determining an angle includes determining a velocity of said golf ball based said identified subset of said radar data, said angle is determined based on said velocity.

56. An apparatus for determining speed information for a golf club, comprising:

one or more radar units; and a processor in communication with said one or more radar units, and processor performs a method comprising the steps of:

accessing radar data for multiple moving objects, said radar data is from said two or more radsar units, said moving objects include a golf club, identifying a subset of said radar data pertaining to said golf club during a swing of said golf club, and determining a speed of said golf club during said swing based on said subset of said radar data.

57. An apparatus according to claim 56, wherein said method further comprises the steps of:

receiving information from said radar units; and processing said information using a frequency-time resolution algorithm, said radar data is a result of said frequency-time resolution algorithm.

58. An apparatus according to claim 56, further comprising:

a first interface in communication with a first radar unit;

a second interface in communication with a second radar unit; and a data concentrator in communication with said first interface and said second interface, said data concentrator is in communication with said processor, said data concentrator receives information from said first interface and said second interface and provides said information to said processor.

59. An apparatus according to claim 56, wherein:

said step of determining a speed includes determining a velocity of said golf club during said swing based said identified subset of said radar data, said speed of said golf club is determined based on said velocity.

60. An apparatus for determining speed information for a golf ball, comprising:

two or more radar units; and a processor in communication with said one or more radar units, said processor performs a method comprising the steps of:

accessing radar data for multiple moving objects, said radar data is from said two or more radar units, said multiple moving objects include a golf ball, identifying a subset of said radar pertaining to said golf ball, and determining a speed of said golf ball based on said subset of said radar data.

61. An apparatus according to claim 60, wherein said method further comprises the steps of:

receiving information from said radar units; and processing said information using a frequency-time resolution algorithm, said radar data is a result of said frequency-time resolution algorithm.

62. An apparatus according to claim 60, further comprising:

a first interface in communication with a first radar unit;

a second interface in communication with a second radar unit; and a data concentrator in communication with said first interface and said second interface, said data concentrator is in communication with said processor, said data concentrator receives information from said first interface and said second interface and provides said information to said processor.

63. An apparatus according to claim 60, wherein:

said step of determining a speed includes determining a velocity of said golf ball based said identified subset of said radar data, said speed of said golf ball is determined based on said velocity.

* * * * *

UNITED STATES PATENT AND TRADEMARK OFFICE

CERTIFICATE OF CORRECTION

PATENT NO. : 6,456,232 B1
DATED : September 24, 2002
INVENTOR(S) : Milnes et al.

It is certified that error appears in the above-identified patent and that said Letters Patent is hereby corrected as shown below:

Column 15,
Line 2, after “collision” and before “a” delete “in” and substitute -- is --

Column 17,
Line 66, after “units,” and before “ processor” replace “and” with -- said --

Column 18,
Line 2, after “more” and before “units” delete “radsar” and insert -- radar --
Line 3, after “said” and before “moving” insert -- multiple --

Signed and Sealed this

Thirty-first Day of August, 2004

JON W. DUDAS
*Director of the United States Patent and Trademark Office*